US008913913B2

(12) United States Patent
Kitajima

(10) Patent No.: US 8,913,913 B2
(45) **Date of Patent: *Dec. 16, 2014**

(54) IMAGE RECORDING APPARATUS

(71) Applicant: Brother Kogyo Kabushiki Kaisha, Aichi (JP)

(72) Inventor: Tetsuya Kitajima, Aichi (JP)

(73) Assignee: Brother Kogyo Kabushiki Kaisha, Nagoya, Aichi (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/628,981

(22) Filed: Sep. 27, 2012

(65) Prior Publication Data

US 2013/0106939 A1 May 2, 2013

(30) Foreign Application Priority Data

Oct. 31, 2011 (JP) ..... 2011-239351

(51) Int. Cl.
*G03G 21/20* (2006.01)

(52) U.S. Cl.
USPC ..... 399/92; 399/94; 347/222

(58) Field of Classification Search
USPC ..... 347/5, 9, 16, 17, 222; 399/92, 94
See application file for complete search history.

(56) References Cited

U.S. PATENT DOCUMENTS 5,907,745 A 5/1999 Azuma et al.
6,344,869 B2 * 2/2002 Sasaki et al. ..... 347/222
6,415,118 B1 * 7/2002 Setoriyama et al. ..... 399/92
6,473,152 B1 10/2002 Yokota
7,599,641 B2 * 10/2009 Yoshihara et al. ..... 399/94
2001/0053300 A1 12/2001 Endo et al.
2004/0234291 A1 11/2004 Iikawa et al.
2006/0114654 A1 6/2006 Kiyosumi

FOREIGN PATENT DOCUMENTS

CN 1246664 A 3/2000
JP 7-140818 6/1995

(Continued)

OTHER PUBLICATIONS

Extended European Search Report and Search Opinion dated Feb. 21, 2013 from related Application No. 12186287.4 and U.S. Appl. No. 13/628,973.

(Continued)

*Primary Examiner* — Lam S Nguyen
(74) *Attorney, Agent, or Firm* — Scully, Scott, Murphy & Presser, PC

(57) ABSTRACT

An image recording apparatus, comprising: a recording device; a cassette; a discharge tray; a conveying path; a conveyor; an electrical power supply; a cooling air flow path; an air blower to apply a wind-force to air; a casing; and an additional cassette device attached to a lower portion of the casing, and in this configuration, the additional cassette device comprises: an additional cassette and an additional conveying path. A relay path is provided between the additional conveying path and the conveying path. The electrical power supply and the cooling air flow path are arranged under the cassette. The electrical power supply is arranged to overlap with the cassette when viewed along the vertical direction, and the cooling air flow path is formed not to intersect with the relay path.

6 Claims, 7 Drawing Sheets

(56) References Cited

FOREIGN PATENT DOCUMENTS

| | | | |
|---|---|---|---|
| JP | 11-305637 | | 11/1999 |
| JP | 2001-353899 | A | 12/2001 |
| JP | 2004-272089 | A | 9/2004 |
| JP | 2004-341374 | A | 12/2004 |
| JP | 2006-154462 | A | 6/2006 |
| JP | 2009-116092 | | 5/2009 |
| JP | 2009-198681 | | 9/2009 |

OTHER PUBLICATIONS

U.S. Office Action dated Aug. 1, 2014 from related U.S. Appl. No. 13/628,973.

Notification of First Office Action dated Aug. 5, 2014 received from the Chinese Patent Office in CN application No. 201210375863.8 together with English language translation.

* cited by examiner

IMAGE RECORDING APPARATUS

CROSS-REFERENCE TO RELATED APPLICATION

This application claims priority under 35 U.S.C. §119 from Japanese Patent Application No. 2011-239351, filed on Oct. 31, 2011. The entire subject matter of the application is incorporated herein by reference.

BACKGROUND

1. Technical Field

Aspects of the present invention relate to an image recording apparatus having a carrying path along which a recording medium is carried, and a cooling air flow path along which air for cooling an electrical power supply flows.

2. Related Art

An image forming device which includes a carrying path along which a sheet-like medium is carried, and a flowing path along which air for cooling an electrical power supply flows is known. The image forming device of this type is configured such that outside air is taken into a main body of the image forming device through a first air intake, and the electrical power supply is cooled by the outside air, by rotating a fan. The outside air is sucked by the fan through a plurality of ventilation holes formed in a sheet carrying guide, and is discharged to the outside through an air outlet provided on a downstream side of the fan. The sheet-like medium accommodated in a paper supply cassette is carried to a region where image formation is performed by an optical writing unit while being guided along the carrying path. The sheet-like medium on which an image has been formed is ejected to a discharge tray while being guided along the sheet carrying guide having the plurality of ventilation holes. Therefore, regarding the image forming device, there is a concern that the carrying path for the sheet-like medium and the flowing path of the air intersect with each other, and the air flowing through the flowing path badly affects carrying of the sheet-like medium.

SUMMARY

As a result of studying, the inventor of the present invention found that, by arranging a path for a sheet-like medium and a flowing path for air not to intersect with each other, the above described problem can be solved. However, in the above described image forming device in which another paper supply tray is provided at a lower portion of a casing in which a paper supply tray is provided, it is difficult to arrange the path for the recording medium and the flowing path for air not to intersect with each other because a sheet of paper supplied into the inside of the casing from another paper supply tray is carried in the direction orthogonal to a horizontal plane.

Aspects of the present invention are advantageous in that they provide an image recording apparatus configured to prevent air for cooling an electrical power supply from badly affecting carrying of a recording medium.

According to an aspect of the invention, there is provided an image recording apparatus, comprising: a recording device configured to record an image on a recording medium in a recording space, the recording space being defined facing the recording device; a cassette configured to accommodate the recording medium on which the image is to be recorded by the recording device; a discharge tray to which the recording medium on which the image has been formed by the recording device is ejected; a conveying path along which the recording medium is carried from the cassette to the discharge tray via the recording space; a conveyor configured to apply, to the recording medium, a conveying force for conveying the recording medium along the conveying path; an electrical power supply that applies power at least to the conveyor; a cooling air flow path through which air for cooling the electrical power supply flows; an air blower configured to apply a wind-force to air so as to cause the air to flow through the cooling air flow path; a casing that accommodates the recording device, the cassette, the conveying path, the conveyor, the electrical power supply, the cooling air flow path and the air blower; and an additional cassette device that is attached to a lower portion of the casing and is arranged under the casing in a vertical direction. In this configuration, the additional cassette device comprises: an additional cassette configured to accommodate a recording medium on which an image is to be recorded by the recording device; and an additional conveying path along which the recording medium accommodated in the additional cassette is carried to the conveying path. A relay path is provided in the casing such that an end of the relay path is connected to a downstream side end of the additional conveying path and an other end of the relay path flows into the conveying path. The electrical power supply and the cooling air flow path are arranged in a lower region in the vertical direction with respect to the cassette, the conveying path and the recording device. The recording device is located, in regard to the vertical direction, at a position higher than or equal to the cassette. The electrical power supply is arranged to overlap with the cassette when viewed along the vertical direction. The cooling air flow path is formed not to intersect with the relay path.

With this configuration, it becomes possible to prevent air for cooling an electrical power supply from badly affecting carrying of a recording medium.

BRIEF DESCRIPTION OF THE ACCOMPANYING DRAWINGS

DETAILED DESCRIPTION

Hereafter, an embodiment according to the invention will be described with reference to the accompanying drawings.

Figure 1:
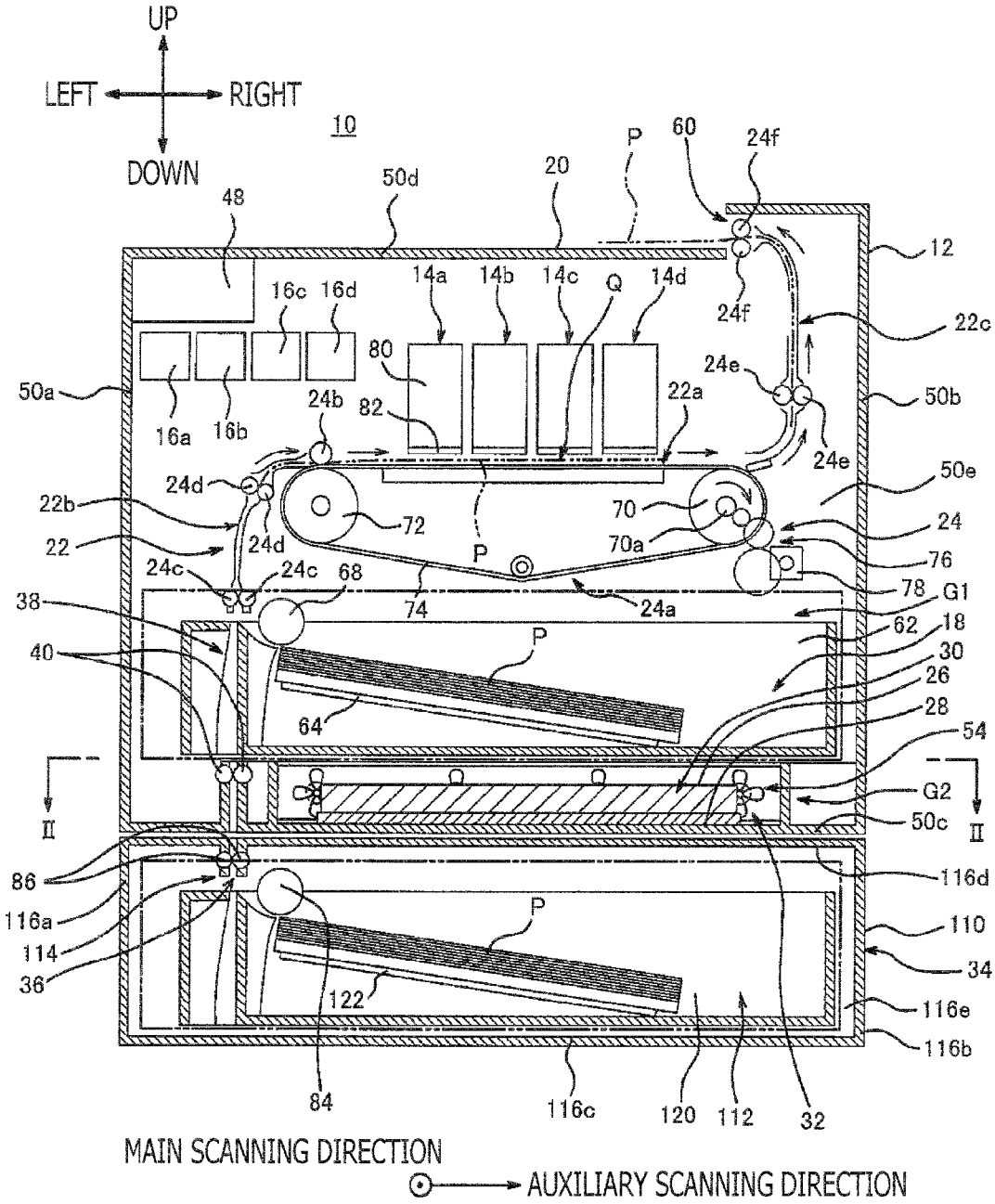
FIG. 1 is a schematic diagram generally illustrating a configuration of an inkjet printer according to an embodiment.

As shown in FIG. 1, an inkjet printer 10 according to the embodiment includes an additional cassette device 34, and is configured such that a user is able to select whether to attach the additional cassette device 34 to the inkjet printer 10 at the user's discretion depending on usage. In the following explanations, an "upper side" means an upper side in the vertical direction, and a "lower side" means a lower side in the vertical direction. The left and right directions are defined with reference to a direction along which the user views. That is, a "front side" means a near side viewed from the user, and a "rear side" means a back side viewed from the user. In this embodiment, the near side on the paper face of FIG. 1 corresponds to the front side.

As shown in FIG. 1, the inkjet printer 10 records an image on a sheet of paper P in a predetermined recording space Q. The inkjet printer 10 includes a casing 12, ink ejection heads 14*a* to 14*d*, ink tanks 16*a* to 16*d* for storing ink, a cassette 18 which accommodates the sheets of paper P, a discharge tray 20 to which the sheet of paper P on which an image has been formed by the ink ejection heads 14*a* to 14*d* is ejected, a conveying path 22 along which the sheet of paper P is carried from the cassette 18 to the discharge tray 20 via the predetermined recording space Q, and a conveyor 24 configured to apply, to the sheet of paper P, a conveying force for conveying the sheet of paper P along the conveying path 22.

As shown in FIG. 1, the inkjet printer 10 includes an electrical power supply 26 which supplies electrical power at least to the conveyor 24, a heatsink 28 which serves to radiate heat from the electrical power supply 26, a cooling air flow path 30 along which air for cooling the electrical power supply 26 flows, and an air blower 32 which applies windforce to the air so that the air flows through the cooling air flow path 30.

Furthermore, as shown in FIG. 1, the inkjet printer 10 includes the additional cassette device 34, a relay path 38 through which the conveying path 22 communicates with an additional conveying path 36 of the additional cassette device 34, a pair of carrying rollers 40 which serves as a "conveyor" for applying conveying force for conveying the sheet of paper P along the relay path 38 to the sheet of paper P, and a control unit 48 which executes various controlling operations.

Figure 2:
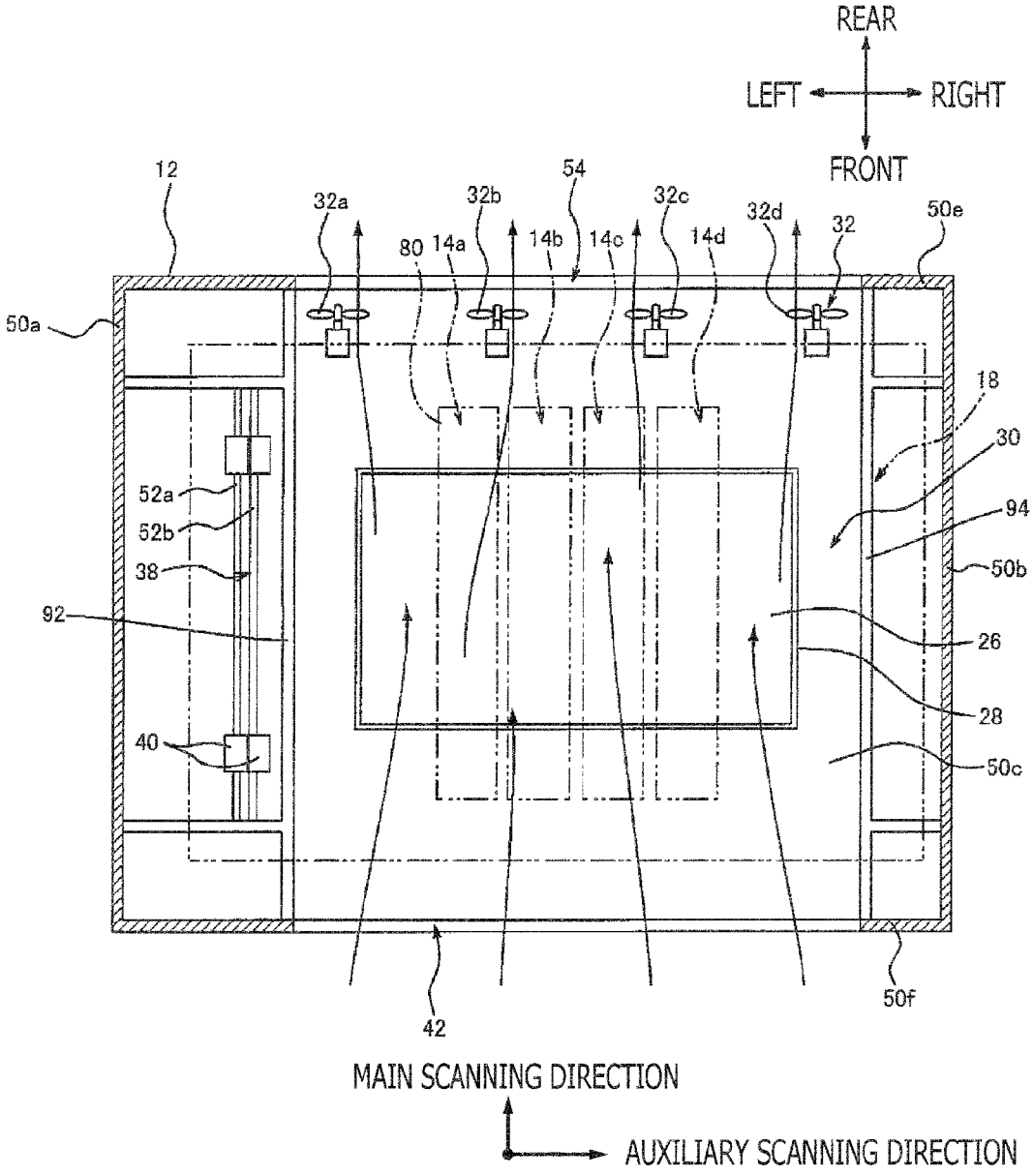
FIG. 2 is a cross section viewed along a line II-II in FIG. 1, illustrating flow of air introduced into a cooling air flow path from an air intake.
Figure 3:
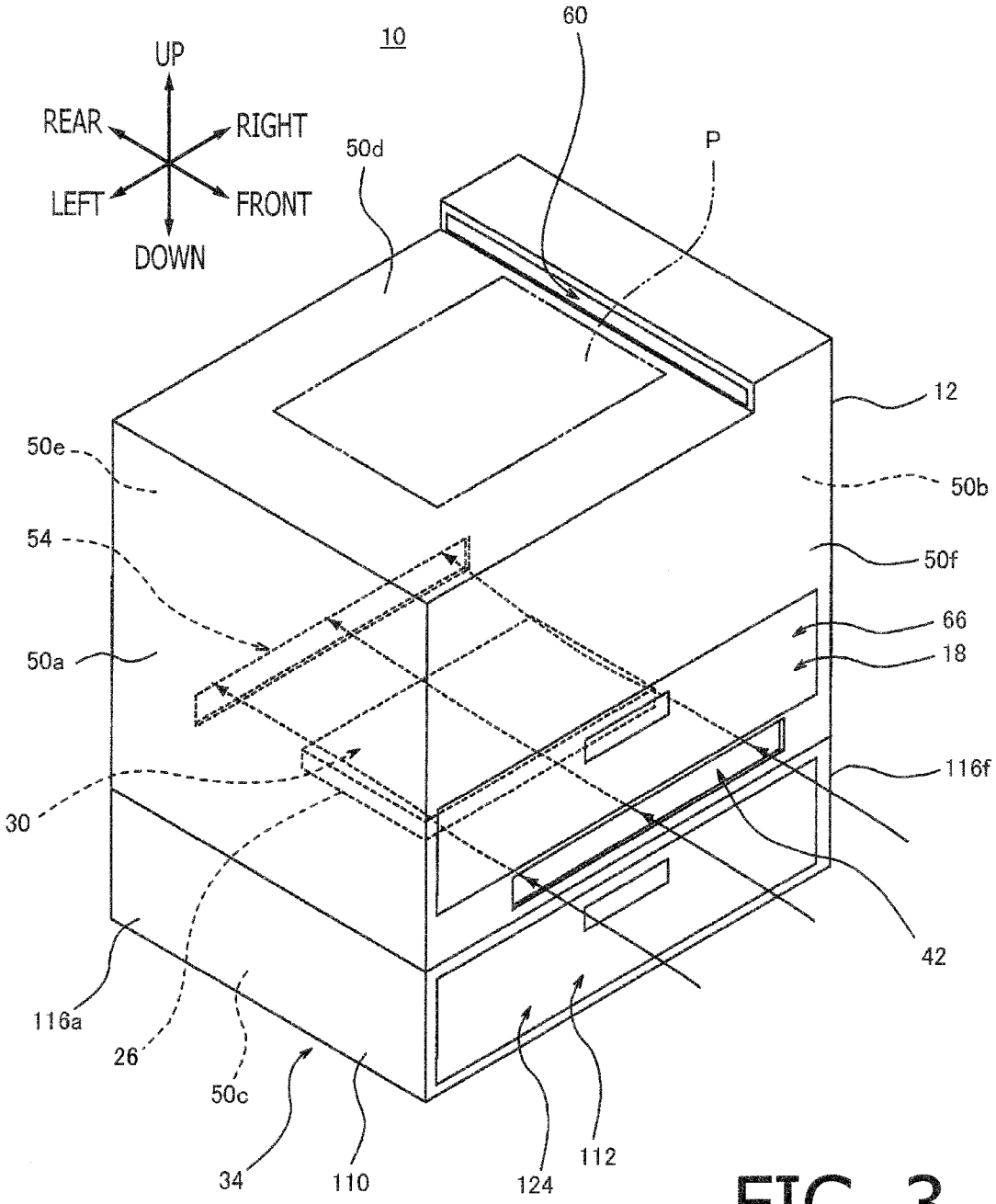
FIG. 3 is a perspective view illustrating a configuration of the inkjet printer according to the embodiment.

As shown in FIG. 3, the casing 12 serves as a housing for accommodating the above described components, and includes a casing left side wall part 50*a*, a casing right side wall part 50*b*, a casing bottom part 50*c*, a casing ceiling part 50*d*, a casing rear wall part 50*e* and a casing front wall part 50*f*. With this configuration, the casing 12 is configured to have a shape of a rectangular parallelepiped elongated in the leaf and right direction. As shown in FIG. 1, in the predetermined recording space Q, the sheet of paper P is carried in the left and right direction. Therefore, as shown in FIG. 2, each of the casing left side wall 50*a* and the casing right side wall 50*b* extends in the vertical direction and in the direction (a main scanning direction) perpendicular to the conveying direction of the sheet of paper P in the predetermined recording space Q. Each of the casing rear wall 50*e* and the casing front wall 50*f* extends in the vertical direction and in the direction (an auxiliary scanning direction) parallel with the conveying direction of the sheet of paper P in the predetermined recording space Q.

As shown in FIG. 3, in the casing front wall part 50*f*, an air intake 42 for introducing eternal air outside the casing 12 into the cooling air flow path 30 is formed to extend in the left and right direction. In the casing rear wall part 50*e*, an air outlet 54 from which the air flowing through the cooling air flow path 30 outputs is formed to extend in the left and right direction, and to face the air intake 42 in the front and rear direction.

Figure 5:
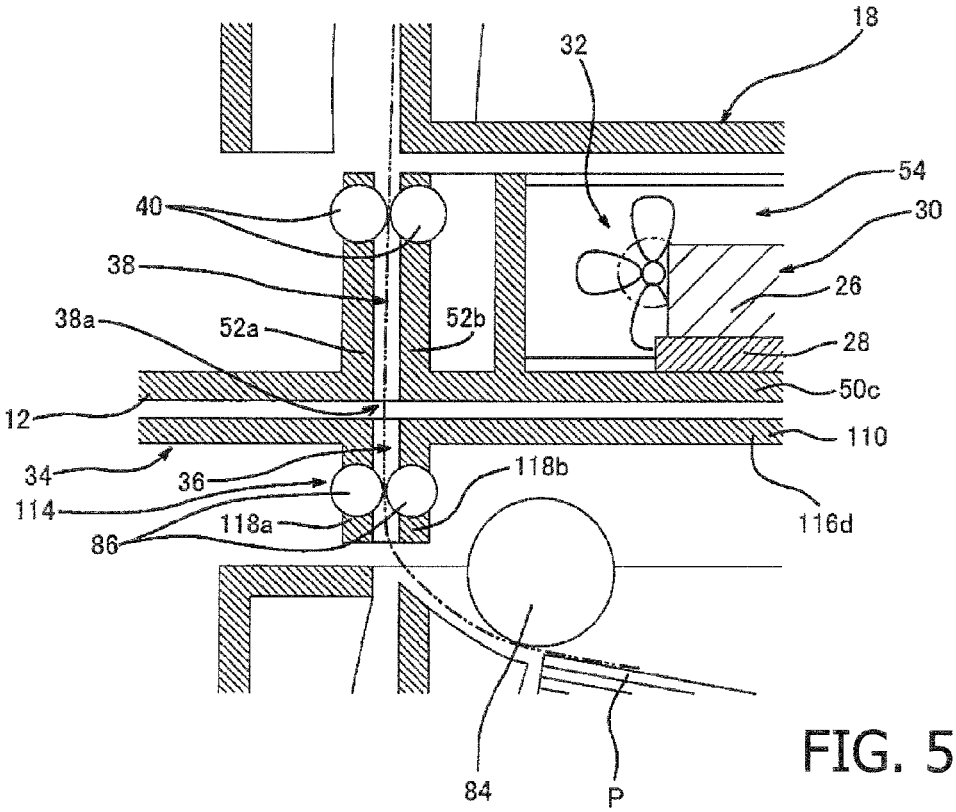
FIG. 5 is an enlarged view illustrating a relay path, the cooling air flow path, the outlet and the air blower.

As shown in FIG. 5, in the casing bottom part 50*c*, an entrance part 38*a* for the relay path 38 is formed to extend in the front and rear direction (a direction orthogonal to a paper face of FIG. 5) in a shape of a slit. At an inner periphery of the entrance part 38*a*, two plate-like parts 52*a* and 52*b* are provided to protrude upward and to face with each other. To the plate-like parts 52*a* and 52*b*, a pair of carrying rollers 40 is attached. The entrance part 38*a* of the relay path 38 serves as an "introducing port" for introducing the sheet of paper P from the outside to the inside of the casing 12. An end of the relay path 38 is connected to the entrance part 38*a*, and the other end of the relay path 38 is formed to flow into the conveying path 22 (see FIG. 1). Therefore, in the state where the additional cassette device 34 is attached to the casing 12 (see FIG. 1), the end of the relay path 38 is connected to the downstream side end of the additional conveying path 36 via the entrance part 38.

As shown in FIG. 3, on the casing ceiling part 50*d*, a paper ejection opening 60 through which the sheet of paper P is ejected in the left and right direction is provided. A leftward portion with respect to the paper ejection opening 60 on the top face of the casing 12 is formed as an ejection part 20 to which the sheet of paper P is ejected.

As shown in FIG. 1, in a region lower than the central portion of the casing 12 in the vertical direction, a first accommodation part 18 having a quadrangular shape when viewed as a plan view (see FIG. 2) is arranged horizontally. The inner space of the casing 12 is divided into a first region G1 located on the upper side of the first accommodation part 18, and a second region G2 located on the lower side of the first accommodation part 18. In the first region G1, the ink ejection heads 14*a* to 14*d*, the ink tanks 16*a* to 16*d*, the conveying path 22, the conveyor 24, and the control unit 48 are arranged. In the second region G2, the electrical power supply 26, the heatsink 28, the cooling air flow path 30, the air blower 32, the relay path 38 and the pair of carrying rollers 40 are provided.

As shown in FIG. 1, the first accommodation part 18 is a tray-like container having a shape elongated in the conveying direction of the sheet of paper P in the predetermined recording space Q. The first accommodation part 18 includes a container body 62 which accommodates a stack of sheets of paper P, a support plate 64 which supports the sheet of paper P in the inside of the container body 62 and a spring (not shown) which presses upward the front of the support plate 64. As shown in FIG. 3, at a portion in the casing front wall part 50*f* corresponding to the first accommodation part 18, an insertion hole 66 is formed so that the first accommodation part 18 can be detachably attachable to the inside of the casing 22 through the insertion hole 66. In this embodiment, the insertion hole 66 is provided at a position above the air intake 42 and separately from the air intake 42. However, in another embodiment, the insertion hole 66 and the air intake 42 may be formed integrally as a single opening.

As shown in FIG. 1, the conveying path 22 is constituted by a horizontal path 22*a* for carrying the sheet of paper P in the horizontal direction in the predetermined recording space Q, a supply path 22*b* for carrying the sheet of paper P accommodated in the first accommodation part 18 to the horizontal path 22*a*, and an ejecting path 22*c* for carrying the sheet of paper P which has passed the horizontal path 22*a* to the discharge tray 20, to thereby have a shape of a letter "S". Along the conveying path 22, components forming the conveyor 24 are arranged.

As shown in FIG. 1, the conveyor 24 includes a carrying unit 24*a* which applies conveying force to the sheet of paper P for conveying the sheet of paper P on the horizontal path 22*a*, a supply roller 24*b* which supplies the sheet of paper P to the carrying unit 24*a* at a predetermined timing, carrying rollers 24*c* and 24*d* which apply the conveying force to the sheet of paper P for conveying the sheet of paper P along the supply path 22*b*, carrying rollers 24*e* and 24*f* which apply the conveying force to the sheet of paper P for carrying the sheet of paper P along the ejection path 22*c*, and a pick-up roller 68 which picks ups the sheet of paper P in the cassette 18 one by one and supplies the sheet of paper P to the supply path 22*b*. The carrying unit 24*a* includes a drive pulley 70, a driven pulley 72, an endless belt provided to extend between the pulleys 70 and 72, and a drive motor 78 connected to a rotation shaft 70*a* of the drive pulley 70 via a gear unit 76. The drive motor 78 of the carrying unit 24*a*, a drive motor (not shown) for the supply roller 24*b*. a drive motor (not shown) for the carrying rollers 24*c*, 24*d*, 24*e* and 24*f* and a drive motor for the pick-up roller 69 are electrically connected to the electrical power supply 26 and the control unit 48.

In FIG. 1, the rotation direction of each of the drive pulley 70 and the endless belt 74 is the clockwise direction, and the sheet of paper P is carried from the left side to the right side. That is, the conveying direction of the sheet of paper P in the predetermined recording space Q is perpendicular to the direction in which the first accommodation part 18 is inserted from the insertion hole 66 (FIG. 3) and the direction in which the air is introduced from the air intake 42 (FIG. 3). As shown in FIG. 1, in this embodiment, the central portion of the horizontal path 22*a* in the left and right direction is located at the predetermined recording space Q, and the ink ejection heads 14*a* to 14*d* are located on the upper side of the predetermined recording space Q. Therefore, the conveying direction of the sheet of paper P in the predetermined recording space Q is the "auxiliary scanning direction", and the direction perpendicular to the auxiliary scanning direction is the "main scanning direction".

As shown in FIG. 1, the inject printer 10 according to the embodiment is a line-type color printer. As shown in FIG. 1, each of the ink ejection heads 14*a* to 14*d* has a rectangular parallelepiped head holder 80 (FIG. 2) extending in the main scanning direction, and an ejection head 82. In addition, the ink tanks 16*a* to 16*d* respectively storing ink of difference colors (magenta, cyan, yellow, black) are provided for the ink jet heads 14*a* to 14*d*, respectively. The ejection head 82 includes a piezoelectric actuator having a known structure driven by a driving voltage. As shown in FIG. 2, each of the ink jet heads 14*a* to 14*d* is arranged to overlap with the first accommodation part 18 when viewed along the vertical direction so that the ink leaking from the ink ejection heads 14*a* to 14*d* is received by the first accommodation part 18. The ejection heads 82 of the respective ink jet heads 14*a* to 14*d* are electrically connected to the electrical power supply 26 and the control unit 48.

As shown in FIG. 2, the electrical power supply 26 supplies power to the various electric components, and includes a substrate and a power supply circuit (not shown) provided on the substrate. The electrical power supply 26 according to the embodiment has a quadrangular shape when viewed as a plan view. When viewed along the vertical direction, the electrical power supply 26 is arranged to overlap with the first accommodation part 19. As shown in FIG. 1, to the electrical power supply 26, the electric components including the conveyor 124, the ink ejection heads 14*a* to 14*d*, the carrying roller 40, the air blower 32 and the control unit 48 are electrically connected.

As shown in FIG. 2, the heatsink 28 radiates heat produced in the electrical power supply 26, and is formed to be a quadrangular plate-like member made of metal, such as aluminum. As shown in FIG. 1, the heatsink 28 is arranged on the top face of the casing bottom part 50*c*, and the electrical power supply 26 is arranged on the top face of the heatsink 28.

As shown in FIG. 1, the cooling air flow path 30 is a flow path along which the air for cooling the electrical power supply 26 flows under the first accommodation part 18. The cooling air flow path 30 is arranged to extend, in a horizontal plane, in the direction intersecting with the conveying direction of the sheet of paper P in the predetermined recording space Q. As shown in FIG. 2, the cooling air flow path 30 is formed in a shape of a rectangular parallelepiped elongated in the left and right direction by a plate part 92 provided on the left side of the electrical power supply 26, a plate part 94 provided on the right side of the electrical power supply 26 and the first accommodation part 18. The electrical power supply 26 is arranged at the central portion in the left and right direction and at the central portion in the front and rear direction in the first accommodation part 18.

As shown in FIG. 2, the air intake 42 for introducing the air outside of the casing 12 into the cooling air flow path 30 is provided at a portion on the casing front wall part 50*f* corresponding to the cooling air flow path 30. Furthermore, as shown in FIG. 2, the air outlet 54 from which the air flowing through the cooling air flow path 30 exits is provided at a portion on the casing rear wall part 50*e* corresponding to the cooling air flow path 30. Furthermore, as shown in FIG. 2, the air blower 32 which sucks the air in the cooling air flow path 30 and discharges the air from the air outlet 54 is provided at a position on the rear side of the electrical power supply 26 in the cooling air flow path 30. As shown in FIG. 2, the air intake 42 and the air outlet 54 are arranged to face with each other, and a left edge of each of the air intake 42 and the air outlet 54 is positioned on the left side with respect to a left edge of the electrical power supply 26, and a right edge of each of the air intake 42 and the air outlet 54 is positioned on the right side with respect to a right edge of the electrical power supply 26.

Figure 4:
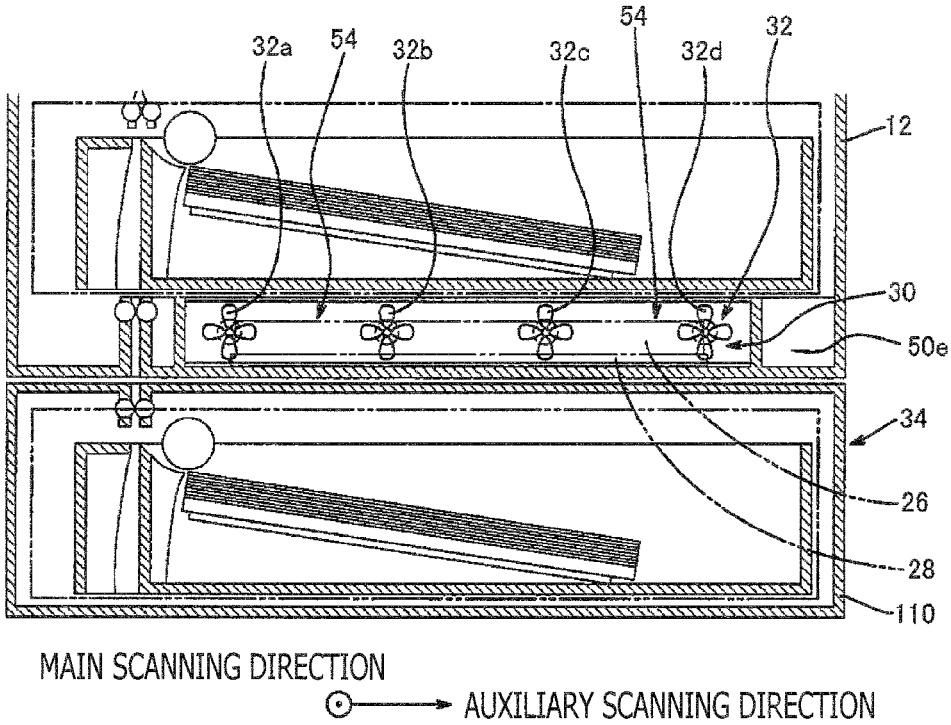
FIG. 4 is an enlarged view illustrating a positional relationship between an air blower and an outlet in a vertical direction.

As shown in FIG. 4, the air blower 32 applies the wind-force to the air to flow in the cooling air flow path 30. In this embodiment, the air blower 32 includes four fans 32*a* to 32*d* arranged in the left and right direction along the air outlet 54. It should be noted that the number of fans is not limited to the example described above, and, in another embodiment, only one fan may be provided.

As shown in FIG. 1, the additional cassette device 34 is attached to the lower portion of the casing 12, and is an accessory device arranged at the lower portion of the casing 12. The additional cassette device 34 includes an additional casing 110, an additional cassette 112 which accommodates the sheet of paper P on which an image is formed by the ink ejection heads 14*a* to 14*d*, the additional conveying path 36 for conveying the sheet of paper P accommodated in the additional cassette 112 to the conveying path 22, and an additional conveyor 114 which applies, to the sheet of paper P, conveying force for conveying the sheet of paper P in the additional conveying path 36.

As shown in FIG. 1, the additional casing 110 is a housing which accommodates the additional cassette 112, the additional conveying path 36 and the additional conveyor 114. The additional casing 110 is formed to be a rectangular parallelepiped elongated in the left and right direction by a unit left wall part 116*a* located under the casing front wall part 50*a*, a unit right wall part 116*b* located under the casing right wall part 50*b*, a unit rear wall part 116*e* located under the casing rear wall part 50*e*, a unit front wall part 116*f* (FIG. 3) located under the casing front wall part 50*f* (FIG. 3), a unit bottom part 116*c* and a unit ceiling part 116*d*. As shown in FIG. 5, on a lower surface of the unit ceiling part 116*d*, two plate parts 118*a* and 118*b* constituting the additional conveying path 36 are formed to face with each other. To the plate parts 118*a* and 118*b*, a pair of carrying rollers 86 constituting the additional conveyor 114 is attached, respectively.

As shown in FIG. 1, the additional cassette 112 is a tray-like container having a shape elongated in the conveying direction of the sheet of paper P in the predetermined recording space Q. The additional cassette 112 includes a container body 120 which accommodates a stack of sheets of paper P, a support plate 122 which supports the sheet of paper P in the inside container body 120 and a spring (not shown) which presses upward the front of the support plate 122. At the leftward and upper portion of the additional cassette 112, a pick-up roller 84 constituting the additional conveyor 114 is arranged. As shown in FIG. 3, a portion of the unit front wall 116*f* corresponding to the additional cassette 112, an insertion hole 124 is formed so that the additional cassette 112 can be detachably attachable to the inside of the additional casing 110 through the insertion hole 124.

As shown in FIG. 1, when the additional cassette device 34 is attached to the casing 12, the driver motors (not shown) for the pick-up roller 84 and the carrying roller 86 are electrically connected to the electrical power supply 26 and the control unit 48. As a result, the pick-up roller 84 and the carrying roller 86 become able to operate based on signals from the control unit 48.

As shown in FIG. 1, when a power switch (not shown) of the inkjet printer is turned ON, the air blower 32 is driven by power supplied from the electrical power supply 26. Then, as show in FIG. 2, air is introduced from the air intake 42 to the cooling air flow path 30, and air in the cooling air flow path 30 is sucked and discharged from the air outlet 54. At this time, since the cooling air flow path 30 and the relay path 38 are separated by the plate part 92, the cooling air does not pass through the relay path 38. It should be noted that the cooling air application unit 32 may be configured to be driven only when the temperature of the electrical power supply 26 is high.

As shown in FIG. 1, when a printing operation of the inkjet printer 10 is started, the pick-up roller 68 or 84 is driven at a predetermine timing, and the sheet of paper P in the cassette 18 is supplied to the conveying path 22 or the sheet of paper P in the additional cassette 112 is supplied to the conveying path 22 via the additional conveying path 36 and the relay path 38. The sheet of paper P supplied from one of the cassette 18 and the additional cassette 112 is supplied to the predetermined recording space Q, and an image is formed on the surface of the sheet of paper P by ink ejected from the ink ejection heads 14*a* to 14*d*. Thereafter, the sheet of paper P on which the image has been formed is ejected from the paper ejection opening 60 to the discharge tray 20 via the ejection path 22*c* of the conveying path 22.

Figure 6:
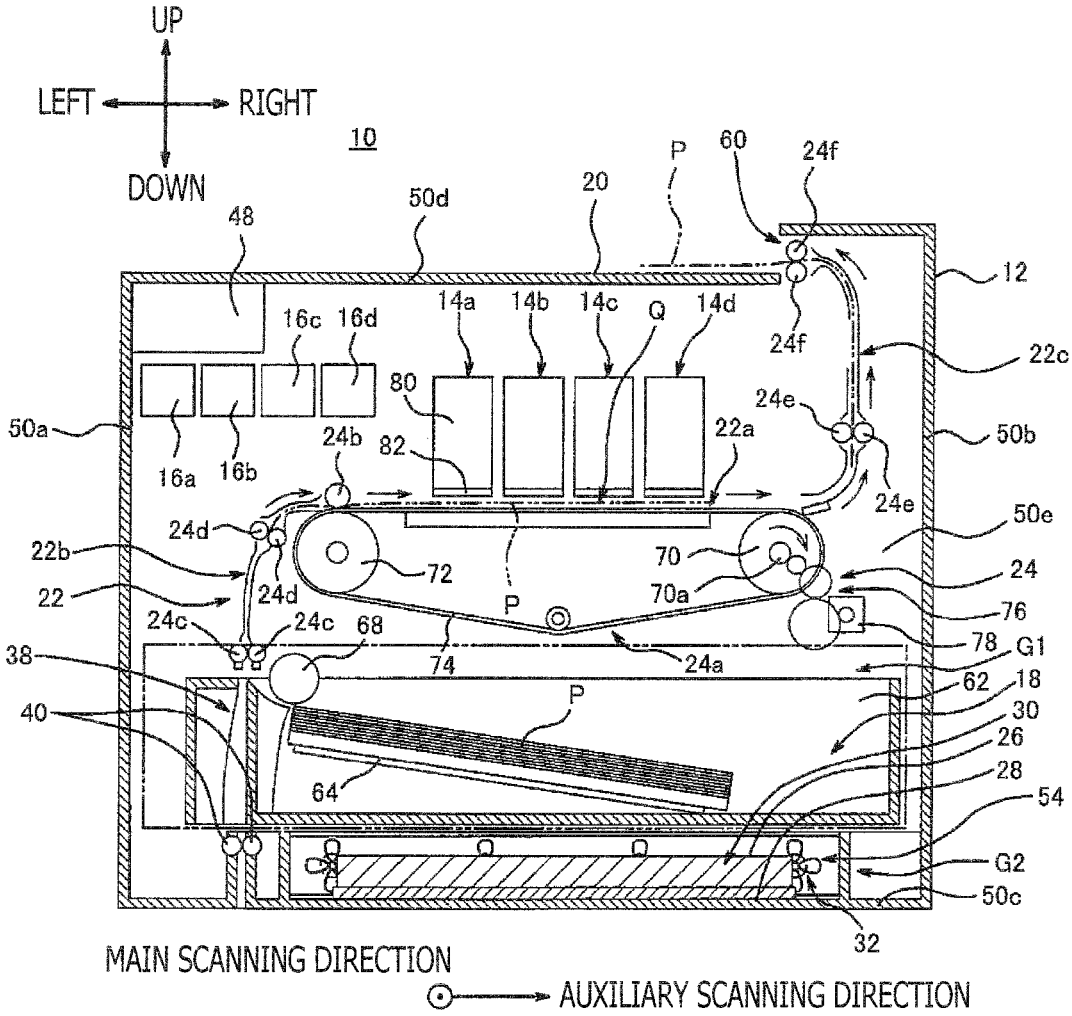
FIG. 6 is a schematic diagram generally illustrating an inkjet printer to which an additional cassette device is attached.

As shown in FIG. 6, when the additional cassette device 34 is not needed, a user is able to detach the additional cassette device 34 from the casing 12. In a state where the additional cassette device 34 is removed from the casing 12, images can be formed on the sheets of paper P by only using the sheets of paper P stored in the cassette 18.

Advantages of the Invention

As shown in FIG. 1, in this embodiment, the electrical power supply 26 and the cooling air flow path 30 are accommodated in the second region G2 located in the vertical direction under the conveying path 22 and the inkjet heads 14*a* to 14*d*, and the air flowing through the cooling air flow path 30 does not hit against the sheet of paper P passing through the conveying path 22. Therefore, it becomes possible to prevent the air in the conveying path 22 from badly affecting the carrying of the sheet of paper P in the cooling air flow path 30. Furthermore, the cooling air flow path 30 is configured to proceed along a path not intersecting with the relay path 38, and the air flowing through the cooling air flow path 30 does not hit against the sheet of paper P passing through the relay path 38. Therefore, it is possible to prevent the air in the relay path 38 from badly affecting the carrying of the sheet of paper P in the relay path 38.

As shown in FIG. 2, the electrical power supply 26 is arranged to overlap with the cassette 18 when viewed along the vertical direction. Therefore, the cassette 18 is able to prevent the ink leaking from the inkjet heads 14*a* to 14*d* and dust caused in the conveying path 22 from falling on the electrical power supply 26.

As shown in FIG. 2, the ink jet heads 14*a* to 14*d* are located to overlap with the cassette 18 when viewed along the vertical direction, it is possible to make the whole device compact in size in the horizontal direction, and the cassette 18 becomes able to prevent the ink leaking from the ink ejection heads 14*a* to 14*d* falling on the electrical power supply 26.

As shown in FIG. 1, since the conveying path 22 having the horizontal path 22*a*, the supply path 22*b* and the ejecting path 22*c* can be formed to be compact and to have a shape of a letter "S", the size of the whole device can be made compact. Furthermore, the conveying path 22 having a form of a letter "S" is arranged in a wide region in the casing 12, and the cooling air flow path 30 is arranged, under the cassette 18 and the conveying path 22, in the second region G2 including an region in which the electrical power supply 26 is provided. Therefore, the air flowing through the cooling air flow path 30 does not hit against the sheet of paper P passing through the conveying path 22.

As shown in FIG. 1, each of the cassette 18 and the additional cassette 112 has the shape elongated in the conveying direction of the sheet of paper P in the predetermined recording space Q, and the cooling air flow path 30 extends, in a horizontal plane, in the direction intersecting with the conveying direction of the sheet of paper P in the predetermined recording space Q. Therefore, it is possible to secure a larger cross sectional area of the cooling air flow path 30. As a result, the blowing capability can be increased by increasing the size of each of the fans 32*a* to 32*d* provided in the cooling air flow path 30 or by increasing the number of fans in the cooling air flow path 30.

As shown in FIG. 3, in the casing front wall part 50*f*, the insertion hole 66 to which the cassette 18 is inserted is formed. Therefore, the user is allowed to easily conduct work for attaching the cassette 18 to or detaching the cassette 18 from the casing 12, from the front side of the casing 12. Furthermore, since the discharge tray 20 is arranged on the casing ceiling part 50*d*, the user is allowed to conduct work for picking up the sheet of paper P ejected to the discharge tray 20, from the front side of the casing 12. Therefore, in cooperation with the advantage in which the cassette 18 can be attached to or removed from the front of the casing 12, the workability can be enhanced. Furthermore, as shown in FIG. 2, the air outlet 54 for the air flowing through the cooling air flow path 30 is formed in the casing rear wall part 44*e*, it becomes possible to prevent the discharged air from hitting against the user who is working on the front side.

As shown in FIG. 3, the air blower 32 is arranged on the downstream side in the flowing direction of air with respect to the region in which the electrical power supply 26 is provided in the cooling air flow path 30. Therefore, it becomes possible to suck the air in the casing 12 and to eject the air, and thereby it becomes possible to prevent the air heated by the heat of the electrical power supply 26 from being diffused in the casing 12.

Other Embodiments

Figure 7:
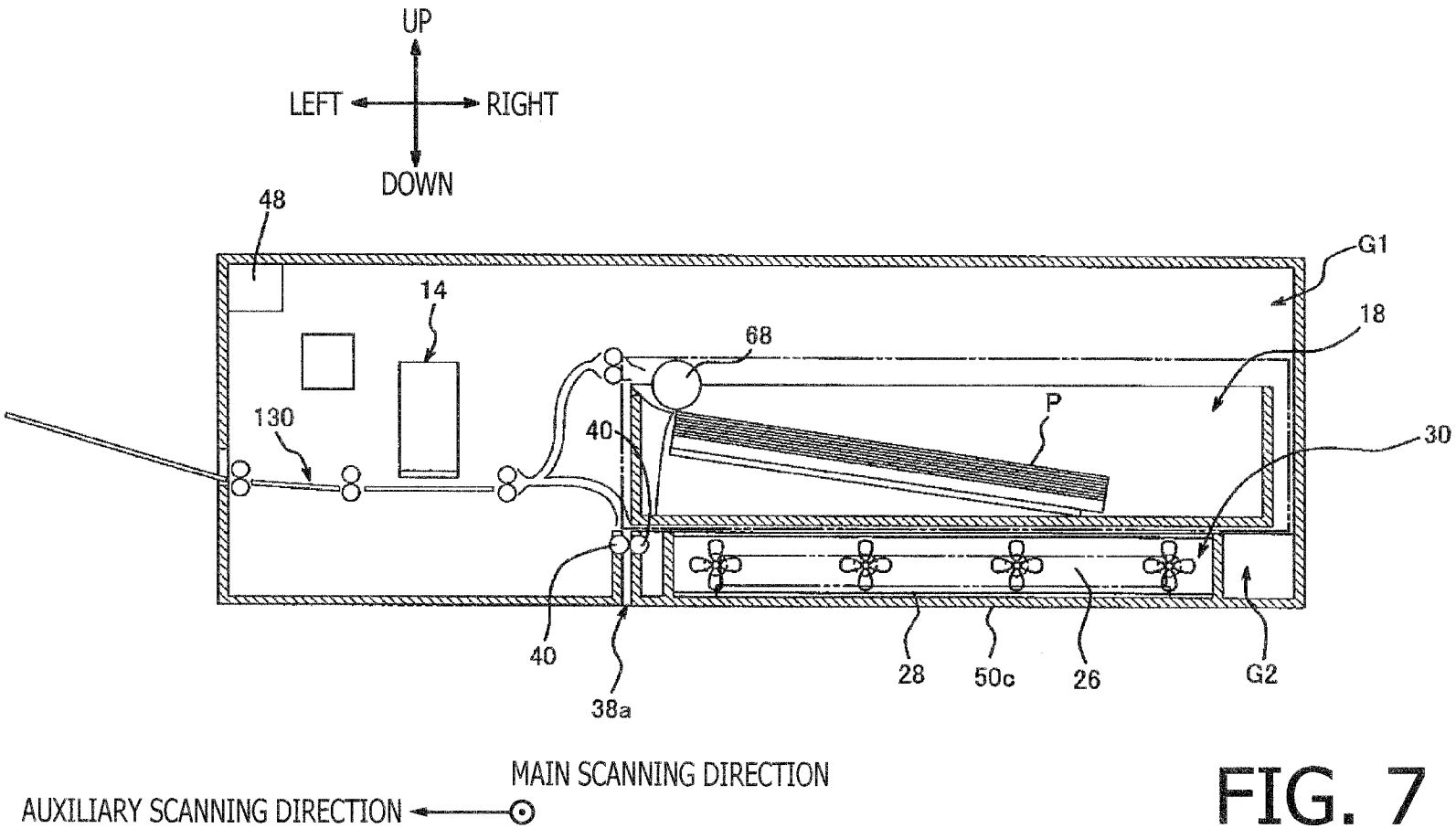
FIG. 7 is a schematic diagram illustrating a configuration of an inkjet printer according to another embodiment.

As shown in FIG. 1, in the embodiment, the ink ejection heads 14*a* to 14*d* serving as a recording device are arranged on the upper side of the cassette 18 in the vertical direction. However, in another embodiment, an ink ejection head 14 may be arranged to have the position equal to the position of the cassette 18 in the vertical direction (i.e., to have the height equal to the height of the cassette 18 as shown in FIG. 7. In this case, the electrical power supply 26 and the cooling air flow path 30 are also arranged in the second region G2 under a conveying path 130 and the ink ejection head 14. Therefore, the air flowing through the cooling air flow path 30 does not het against the sheet of paper P passing through the conveying path 130, and thereby it becomes possible to prevent the air from badly affecting the carrying of the sheet of paper P.

Figure 8:
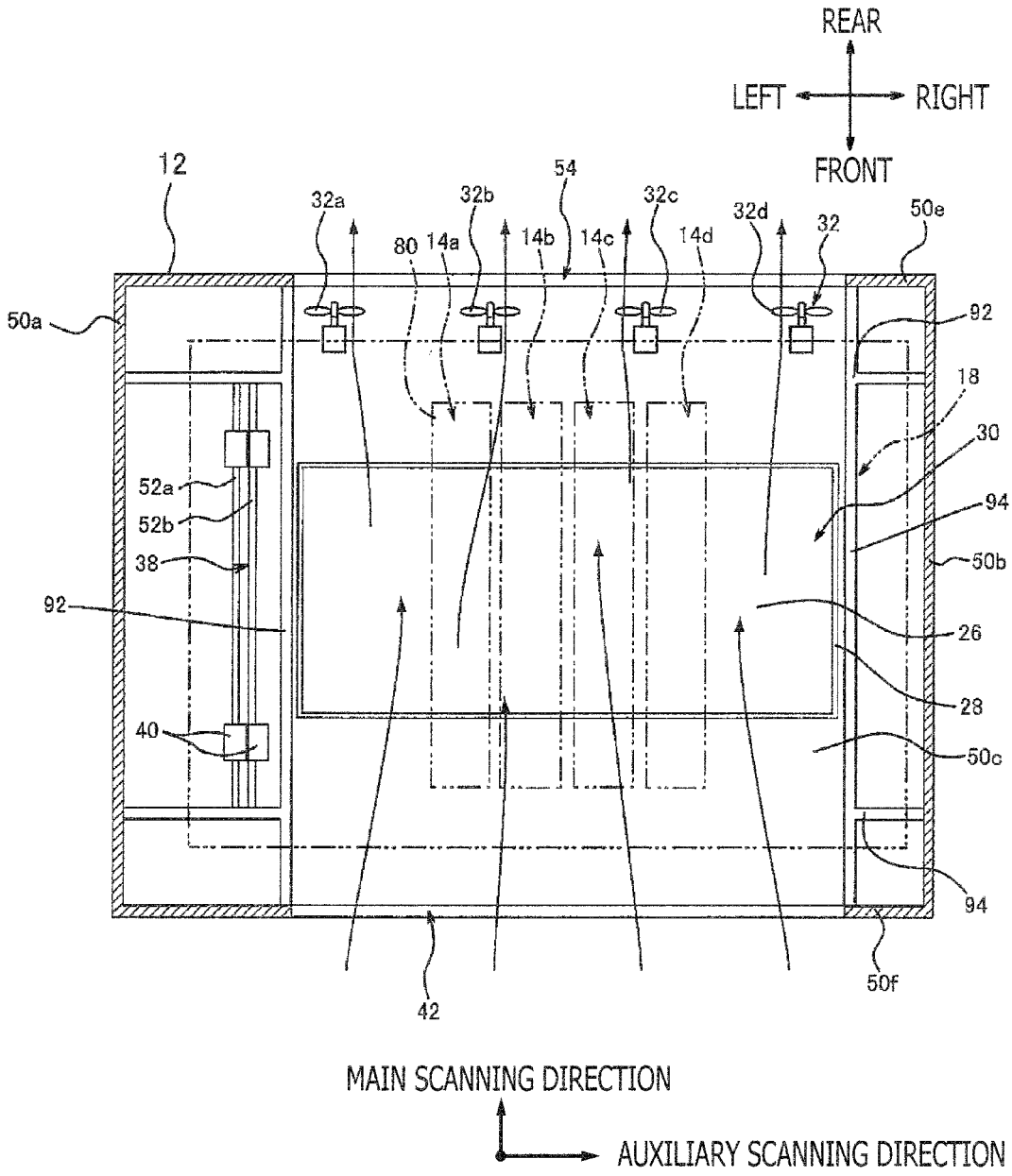
FIG. 8 is a cross section corresponding to FIG. 2 in the inkjet printer according to another embodiment

As shown in FIG. 2, in this embodiment, the electrical power supply 26 is arranged to depart from the plat parts 92 and 94. However, in another embodiment, the electrical power supply 26 may be arranged to be close the plate parts 92 and 94 as shown in FIG. 8. In this case, since it becomes possible to increase the ratio of air flowing along the surface of the cooling air flow path 30 with respect to the air flowing through the cooling air flow path 30, the cooling capability for the electrical power supply 26 can be enhance. As a way to cause the electrical power supply 26 and the plate parts 29 and 94 to become closer to each other, the length of the electrical power supply 26 in the left and right direction may be increased or the interval between the plate parts 92 and 94 may be decreased as shown n FIG. 8.

As shown in FIG. 2, in the above described embodiment, the inner left side surface and the inner right side surface of the cooling air flow path 30 are formed by the plate parts 92 and 94 extending in the front and rear direction. However, in another embodiment, the left side inner surface of the cooling air flow path 30 may be formed by the plate part 52*b* forming the carrying roller 40, and the right side inner wall of the cooling air flow path 30 may be formed by the casing right wall part 50*b*.

As shown in FIG. 1, in the above described embodiment, the present invention is applied to the inkjet printer 10 which ejects ink. However, the present invention may be applied to an image recording apparatus other than the printer, such as a copying machine or a facsimile machine, or may be applied to an image recording apparatus which uses a printing agent (e.g., toner) other than ink. In another embodiment, more than one additional cassette devices 34 may be stacked to have layers.

What is claimed is:

1. An image recording apparatus, comprising:

a recording device configured to record an image on a recording medium in a recording space, the recording space being defined facing the recording device;

a cassette configured to accommodate the recording medium on which the image is to be recorded by the recording device;

a discharge tray configured to stack the recording medium on which the image has been formed by the recording device;

a conveying path along which the recording medium is conveyed from the cassette to the discharge tray via the recording space;

a conveyor configured to apply, to the recording medium, a conveying force for conveying the recording medium along the conveying path;

an electrical power supply configured to supply electrical power at least to the conveyor;

a cooling air flow path through which air for cooling the electrical power supply flows;

an air blower configured to apply a wind-force to air so as to cause the air to flow through the cooling air flow path;

a casing that accommodates the recording device, the cassette, the conveying path, the conveyor, the electrical power supply, the cooling air flow path and the air blower; and an additional cassette device that is attached to a lower portion of the casing and is arranged under the casing in a vertical direction, wherein the additional cassette device comprises:

an additional cassette configured to accommodate a recording medium on which an image is to be recorded by the recording device; and an additional conveying path along which the recording medium accommodated in the additional cassette is conveyed to the conveying path, wherein:

a relay path is provided in the casing such that an end of the relay path is connected to a downstream side end of the additional conveying path and an other end of the relay path flows into the conveying path;

the electrical power supply and the cooling air flow path are arranged in a lower region in the vertical direction with respect to the cassette, the conveying path and the recording device;

the recording device is located, in regard to the vertical direction, at a position higher than or equal to the cassette;

the electrical power supply and the cassette overlap each other in the vertical direction; and the cooling air flow path is formed not to intersect with the relay path.

2. The image recording apparatus according to claim 1, wherein:

each of the cassette and the additional cassette has a shape elongated in a direction equal to a conveying direction of the recording medium in the recording space; and the cooling air flow path is formed to extend, in a horizontal plane, in a direction intersecting with the conveying direction of the recording medium in the recording space.

3. The image recording apparatus according to claim 1, wherein, when one of walls of the casing extending in a vertical direction and in a direction parallel with a conveying direction of the recording medium in the recording space is defined as a casing front wall part, the other of the walls is fiend as a casing rear wall part, and a wall part of the additional cassette device arranged under the casing front wall part in the vertical direction is defined as a cassette front wall part, a first insertion hole into which the cassette is inserted is formed in the casing front wall part, a second insertion hole into which the additional cassette is inserted is formed in the cassette front wall part, an air intake through which an air outside the casing is introduced into the cooling air flow path is formed in the casing front wall, and an air outlet for the air flowing through the cooling air flow path is formed in the casing rear wall part.

4. The image recording apparatus according to claim 1, wherein:

the discharge tray is formed on a top face of the casing in the vertical direction;

the conveying path includes:

a horizontal path through which the recording medium is conveyed horizontally in the recording space;

a supply path through which the recording medium accommodated in the cassette is conveyed to the horizontal path; and an ejection path through which the recording medium which has passed the horizontal path is conveyed.

5. The image recording apparatus according to claim 1, wherein the air blower is arranged, in the cooling air flow path, on a downstream side in a direction in which the air flows, with respect to a region in which the electrical power supply is provided.

6. An image recording apparatus, comprising:

a recording device configured to record an image on a recording medium in a recording space, the recording space being defined facing the recording device;

a cassette configured to accommodate the recording medium on which the image is to be recorded by the recording device;

a discharge tray configured to stack the recording medium on which the image has been formed by the recording device is ejected;

a conveying path along which the recording medium is conveyed from the cassette to the discharge tray via the recording space;

a conveyor configured to apply, to the recording medium, a conveying force for conveying the recording medium along the conveying path;

an electrical power supply configured to supply electrical power at least to the conveyor;

a cooling air flow path through which air for cooling the electrical power supply flows;

an air blower configured to apply a wind-force to air so as to cause the air to flow through the cooling air flow path; and a casing that accommodates the recording device, the cassette, the conveying path, the conveyor, the electrical power supply, the cooling air flow path and the air blower, wherein:

a recording medium introducing hole through which the recording medium is inserted into an inside of the casing from an outside is provided at a bottom constituting a lower surface of the casing in a vertical direction;

a relay path is provided in the casing such that an end of the relay path is connected to the recording medium introducing hole and an other end of the relay path flows into the conveying path;

the electrical power supply and the cooling air flow path are arranged in a lower region in the vertical direction with respect to the cassette, the conveying path and the recording device;

the recording device is located, in regard to the vertical direction, at a position higher than or equal to the cassette;

the electrical power supply and the cassette overlap each other in the vertical direction; and the cooling air flow path is formed not to intersect with the relay path, and extends, in a horizontal plane, to intersect with the conveying direction of the recording medium in the recording space.

* * * * *